US009249695B2

(12) United States Patent
Burke et al.

(10) Patent No.: US 9,249,695 B2
(45) Date of Patent: Feb. 2, 2016

(54) ELECTRIC PHASING OF A CONCENTRIC CAMSHAFT

(71) Applicant: Schaeffler Technologies AG & Co. KG, Herzogenaurach (DE)

(72) Inventors: Steven Burke, Fair Haven, MI (US); Craig Dupuis, Windsor, CA (US); Inhwa Chung, LaSalle, CA (US); Mike Kohrs, Oberreichenbach (DE); Jens Schaefer, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 193 days.

(21) Appl. No.: 13/779,265

(22) Filed: Feb. 27, 2013

(65) Prior Publication Data

US 2014/0076252 A1 Mar. 20, 2014

Related U.S. Application Data

(60) Provisional application No. 61/604,042, filed on Feb. 28, 2012.

(51) Int. Cl.

| | |
|---|---|
| ***F01L 1/34*** | (2006.01) |
| ***F01L 1/352*** | (2006.01) |
| *F01L 1/047* | (2006.01) |

(52) U.S. Cl.

CPC ..... *F01L 1/352* (2013.01); *F01L 2001/0473* (2013.01); *F01L 2001/3521* (2013.01)

(58) Field of Classification Search

CPC ..... F01L 2001/0473; F01L 2001/3521; F01L 1/352; F16H 2049/003; F16H 49/001

See application file for complete search history.

(56) References Cited

U.S. PATENT DOCUMENTS

| | | | | |
|---|---|---|---|---|
| 5,417,186 | A * | 5/1995 | Elrod et al. | 123/90.17 |
| 6,363,896 | B1 | 4/2002 | Speier | |
| 6,805,080 | B2 | 10/2004 | Golovatai-Schmidt et al. | |
| 7,270,094 | B2 | 9/2007 | Mashiki et al. | |
| 7,318,400 | B2 | 1/2008 | Lipke et al. | |
| 8,020,527 | B2 | 9/2011 | Mashiki et al. | |
| 2009/0301416 | A1 | 12/2009 | Watanabe | |
| 2010/0186700 | A1 | 7/2010 | Kandolf et al. | |
| 2011/0197839 | A1 * | 8/2011 | Yoshika et al. | 123/90.17 |

FOREIGN PATENT DOCUMENTS

| | | |
|---|---|---|
| DE | 102005024485 | 11/2006 |
| WO | 95/00748 | 1/1995 |
| WO | 99/36677 | 7/1999 |
| WO | 2009067789 | 6/2009 |

* cited by examiner

*Primary Examiner* — Jesse Bogue
*Assistant Examiner* — Daniel Bernstein
(74) *Attorney, Agent, or Firm* — Simpson & Simpson, PLLC

(57) ABSTRACT

A concentric cam shaft assembly, including: a first camshaft; a second camshaft including at least a portion disposed radially within the first camshaft; and at least one phasing assembly including first and second electric motors and a first input gear arranged to rotate at a first speed in response to receiving rotational torque from a crankshaft of an engine. The rotational torque is arranged to rotate the first and second camshafts. The first electric motor is arranged to circumferentially off-set the first camshaft with respect to the first input gear. The second electric motor is arranged to circumferentially off-set the second camshaft with respect to the first input gear.

14 Claims, 12 Drawing Sheets

ELECTRIC PHASING OF A CONCENTRIC CAMSHAFT

CROSS-REFERENCE TO RELATED APPLICATIONS

This application claims the benefit under 35 U.S.C. §119 (e) of U.S. Provisional Patent Application No. 61/604,042, filed Feb. 28, 2012 which application is incorporated herein by reference.

TECHNICAL FIELD

The present disclosure relates generally to electrically phased concentric camshafts. The present disclosure also relates to concentric camshafts phased using electrically driven harmonic drives. The present disclosure further relates to concentric camshafts in which each camshaft is separately electrically phased, in particular, with harmonic drives.

BACKGROUND

Camshafts are used in internal combustion engines in order to actuate gas exchange valves. The camshaft in an internal combustion engine includes a plurality of cams that engage cam followers (i.e. bucket tappets, finger levers or rocker arms). When the camshaft rotates, the cams lift or depress the cam followers which in turn actuate gas exchange valves (intake, exhaust). The position and shape of the cams dictate the opening period and amplitude as well as the opening and closing time of the gas exchange valves.

Separate intake and exhaust camshaft assemblies are known in which each camshaft and its related cam lobes separately operate intake valves and exhaust valves, respectively.

Concentric camshaft assemblies are also known in which separate intake and exhaust camshafts are concentrically arranged by providing a hollow outer camshaft in which an inner camshaft is located, with the inner camshaft cam lobes being rotatable on the outer camshaft, and connected through slots in the hollow outer camshaft to the inner camshaft. This allows the use of separate camshafts for intake and exhaust valve actuation within generally the same space required for a single camshaft.

Camshaft phasers are used to advance or retard the opening or closing period, phasing the camshaft with respect to the crankshaft rotation. Camshaft phasers generally comprise a timing gear, which can be a chain, belt or gear wheel connected in fixed rotation to a crankshaft by a chain, belt or gear drive, respectively, acting as an input to the phaser. The phaser includes an output connection to the inner or outer camshaft in a concentric camshaft arrangement, or, alternatively, an output connection to an exhaust or intake camshaft. A phasing input is also provided in the form of a hydraulic, pneumatic or electric drive in order to phase or adjust the output rotation of the camshaft relative to the input rotation of the crankshaft.

Camshaft phasers are generally known in two forms, a piston-type phaser with an axially displaceable piston and a vane-type phaser with vanes that can be acted upon and pivoted in the circumferential direction. With either type, the camshaft phaser is fixedly mounted on the end of a camshaft. Camshaft phasers that operate according to the vane-cell principle for use on single camshafts are known in the art. It is also known to use camshaft phasers in connection with concentric camshaft assemblies for controlling the phase position of the inner camshaft, the outer camshaft, or both relative to each other.

Vane-cell type phasers employ a supply of hydraulic fluid, normally engine oil, to opposing chambers in the phaser in order to shift the vanes within the phaser circumferentially and thus selectively phase cam timing. Camshaft phasers are subject to oil loss from the phaser through leakage. During normal engine operation engine oil pressure generated by the engine oil pump is sufficient to keep the cam phaser full of oil and, therefore, functioning properly. However, when the engine is not operating, oil leakage from the cam phaser may leave the cam phaser chambers filled with air. This lack of controlling oil pressure and the presence of air in the chambers during engine start conditions, before the engine oil pump generates enough oil pressure and flow, may cause the phaser to oscillate excessively due to lack of oil. This oscillation may, in turn cause noise or damage to the cam phaser mechanism. In addition, it is desirable to have the cam phaser locked in a particular position during engine start-up.

SUMMARY

According to aspects illustrated herein, there is provided a concentric cam shaft assembly, including: an electric motor; a first camshaft; a second camshaft including at least a portion disposed radially within the first camshaft; an input gear non-rotatably connected to the first camshaft and arranged to rotate at a first speed, with respect to an axis of rotation for the first and second camshafts, in response to receiving rotational torque from a crankshaft of an engine; an output gear non-rotatably connected to the second camshaft; and a harmonic drive including a wave generator; and a flexible gear radially disposed about the wave generator and including a radially inner circumference in contact with the wave generator, and a radially outer circumference with a plurality of drive teeth. The input gear is arranged to rotate the first and second camshafts at the first speed. The electric motor is arranged to rotate the wave generator, with respect to the flexible gear, about an axis of rotation for the wave generator: to change respective radial distances of a plurality of points on the outer circumference of the flexible gear with respect to an axis of rotation for the flexible gear; to urge only a respective portion of the plurality of drive teeth, and not all of the drive teeth, into contact with the one of the input or output gears; and to circumferentially off-set, using an engagement of the respective portion of the plurality of drive teeth with the one of the input or output gears, the second camshaft with respect to the first camshaft.

According to aspects illustrated herein, there is provided a concentric cam shaft assembly, including: a first camshaft; a second camshaft including at least a portion disposed radially within the first camshaft; and at least one phasing assembly including first and second electric motors and a first input gear arranged to rotate at a first speed in response to receiving rotational torque from a crankshaft of an engine. The rotational torque is arranged to rotate the first and second camshafts. The first electric motor is arranged to circumferentially off-set the first camshaft with respect to the first input gear. The second electric motor is arranged to circumferentially off-set the second camshaft with respect to the first input gear.

According to aspects illustrated herein, there is provided a method of operating a concentric cam shaft assembly including an electric motor, a first camshaft, a second camshaft including at least a portion disposed radially within the first camshaft, an input gear non-rotatably connected to the first camshaft, an output gear non-rotatably connected to the second camshaft, and a harmonic drive including a wave generator and a flexible gear radially disposed about the wave generator and including a radially inner circumference in contact with the wave generator, and a radially outer circumference with a plurality of drive teeth, the method including: receiving, with the input gear, rotational torque from a crankshaft of an engine; rotating, with the input gear, the first and second camshafts; rotating, with the electric motor, the wave generator, with respect to the flexible gear, about an axis of rotation for the wave generator; changing, with the wave generator, respective radial distances of a plurality of points on the outer circumference of the flexible gear with respect to an axis of rotation for the flexible gear; urging, with the wave generator, only respective portions of the plurality of drive teeth, and not all of the drive teeth, into contact with one of the input or output gears; engaging the plurality of drive teeth with the one of the input or output gears; and circumferentially off-setting, using an engagement of the respective portion of the plurality of drive teeth with the one of the input or output gears, the second camshaft with respect to the first camshaft.

According to aspects illustrated herein, there is provided a method of operating a concentric cam shaft assembly including a first camshaft; a second camshaft including at least a portion disposed radially within the first camshaft; and at least one phasing assembly including first and second electric motors and a first input gear, the method including: receiving, with the input gear, rotational torque from a crankshaft of an engine; rotating the input gear at a first speed, with respect to an axis of rotation for the first and second camshafts; rotating, with the rotational torque, the first and second camshafts; circumferentially off-setting, using the first electric motor, the first camshaft with respect to the first input gear; and circumferentially off-setting, using the second electric motor, the second camshaft with respect to the first input gear.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Harmonic drives, also known as strain wave gearing, are known and information provided below is limited to that necessary to understand the structure and operation of concentric cam shaft assemblies included in the present disclosure. Information regarding harmonic drives is found in the following references:

4. Sclater, Nicholas (2007). *Mechanisms and Mechanical Devices Sourcebook.* ISBN 0-07-146761-0.
5. Lauletta, Anthony (April 2006). "The Basics of Harmonic Drive Gearing" (PDF). Gear Product News: 32-36.
6. Tuttle, Timothy D. (1992). Understanding and Modeling the Behavior of a Harmonic Drive Gear Transmission (Report). Massachusetts Institute of Technology. http://hdl.handle.net/1721.1/6803.

Figure 1A:
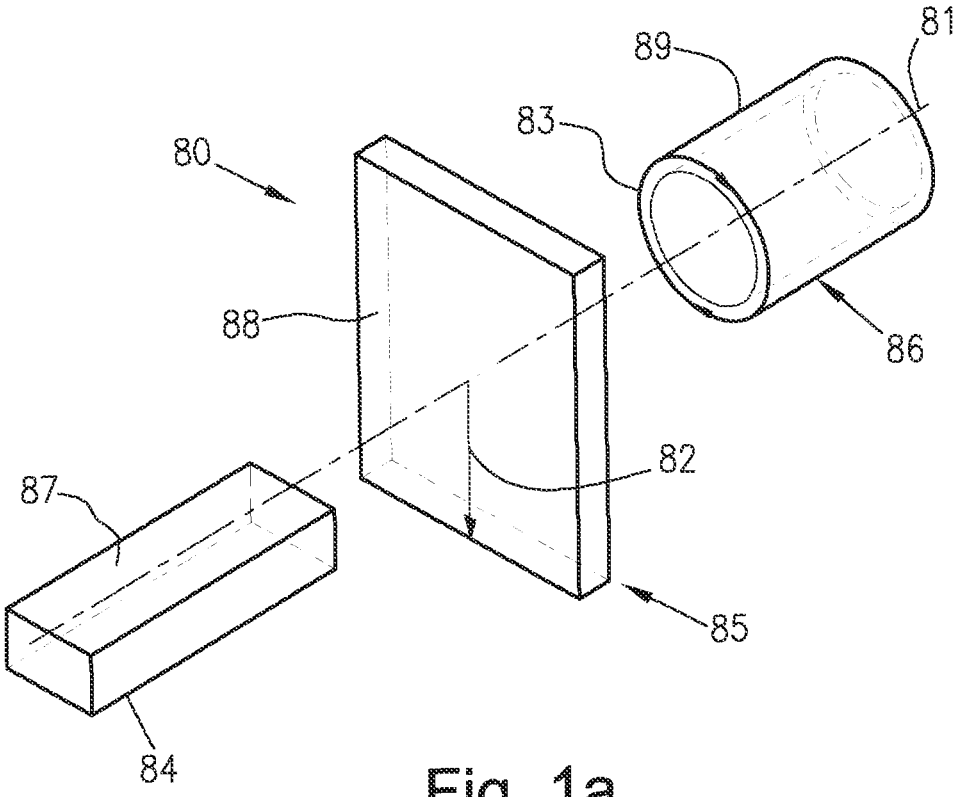
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
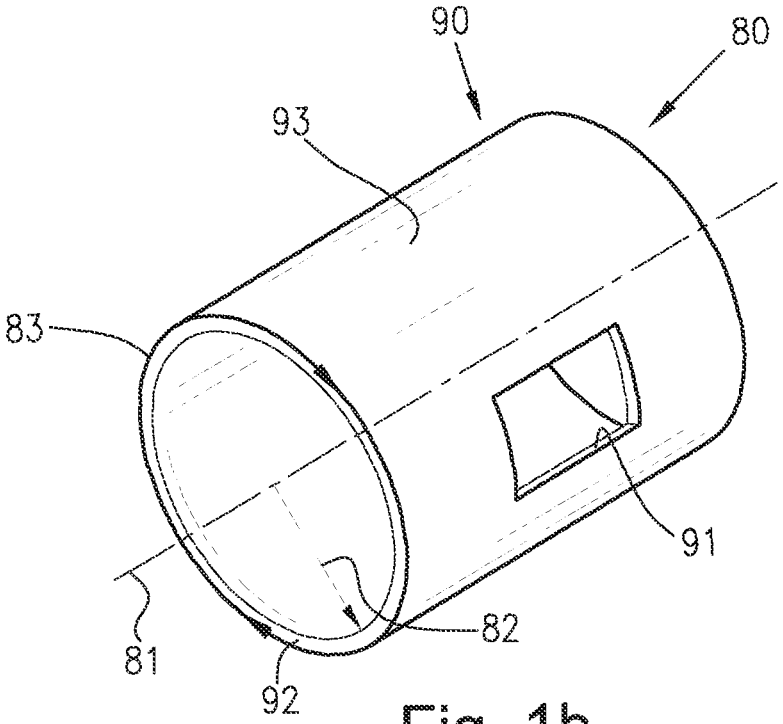
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
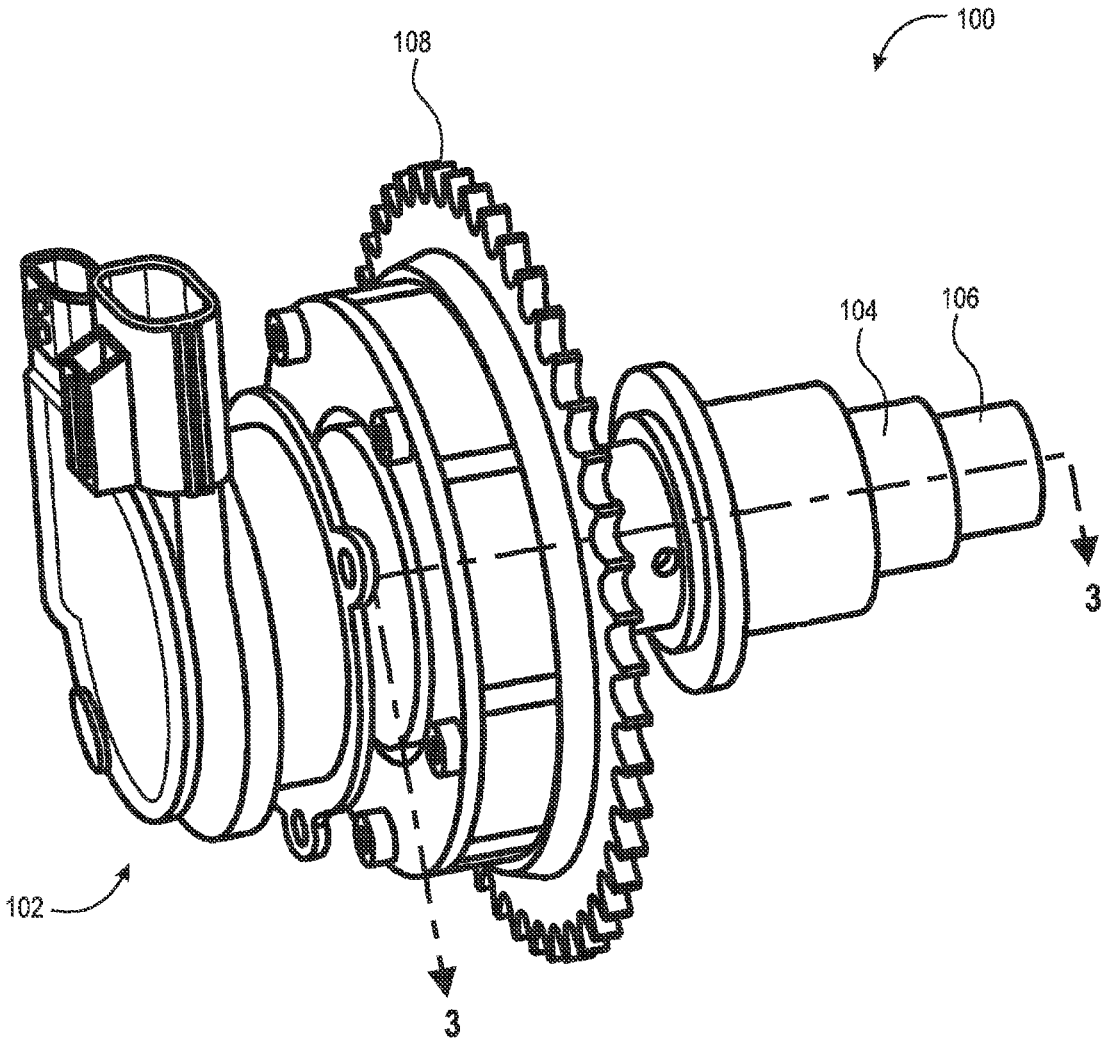
FIG. 2 is a perspective view of a concentric cam shaft assembly with electric phasing.

FIG. 2 is a perspective view of concentric cam shaft assembly 100 with electric phasing.

Figure 3:
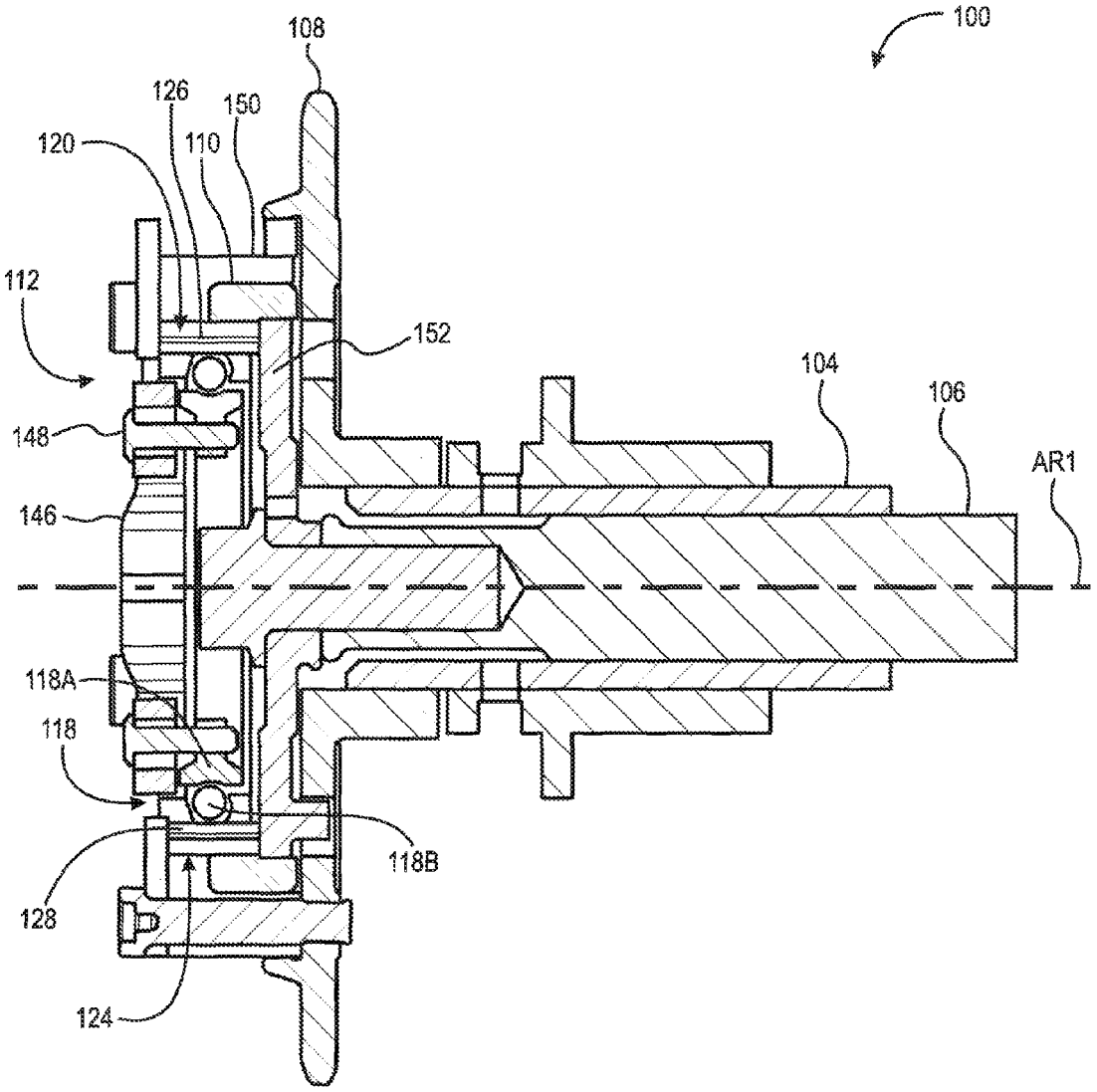
FIG. 3 is a cross-sectional view of the concentric cam shaft assembly of FIG. 2, with the electric motor removed, generally along line 3-3 in FIG. 2.

FIG. 3 is a cross-sectional view of concentric cam shaft assembly 100 of FIG. 2, with the electric motor removed, generally along line 3-3 in FIG. 2.

Figure 4:
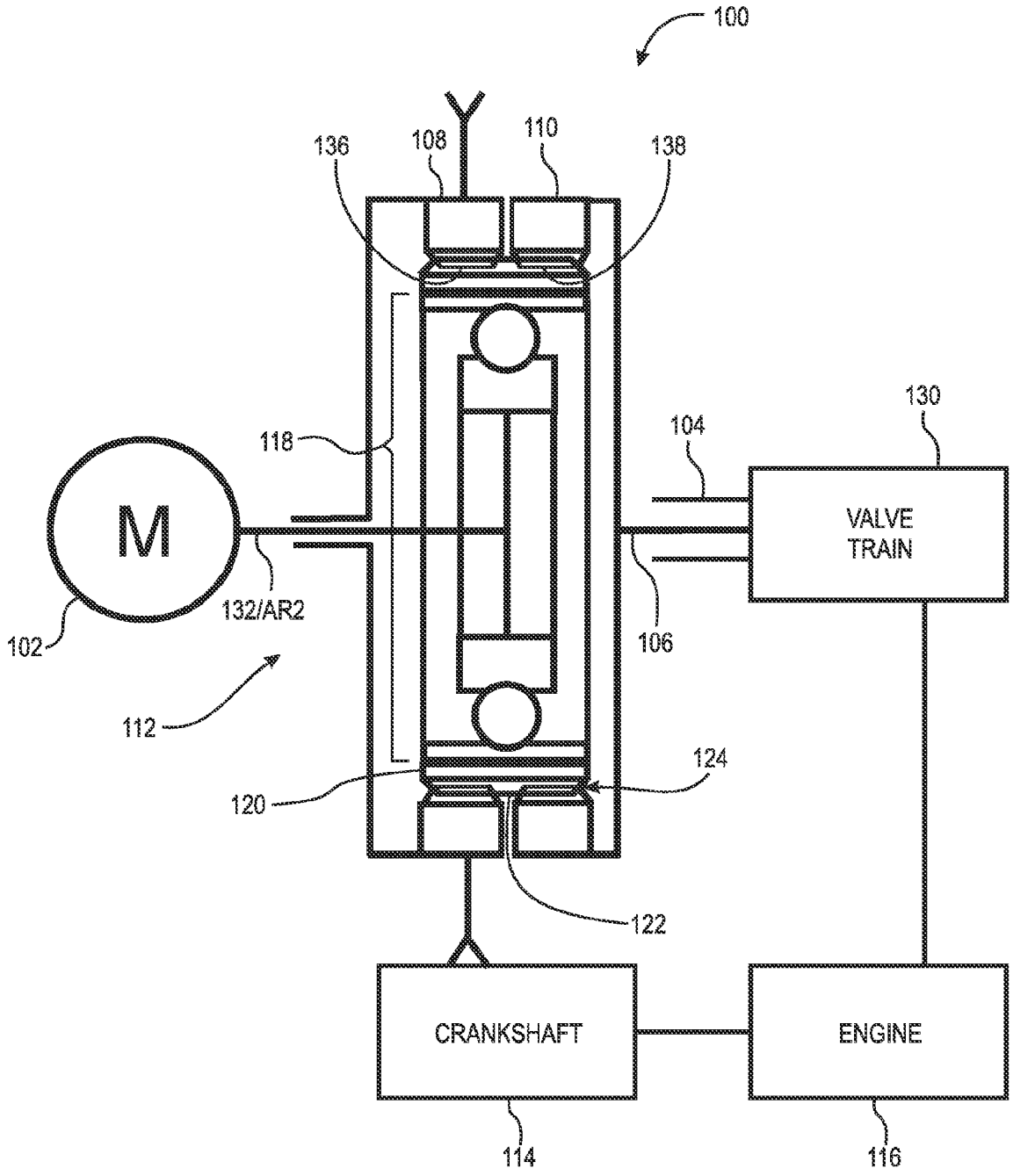
FIG. 4 is a schematic representation of the concentric cam shaft assembly of FIG. 2.

FIG. 4 is a schematic representation of concentric cam shaft assembly 100 of FIG. 2.

Figure 5A:
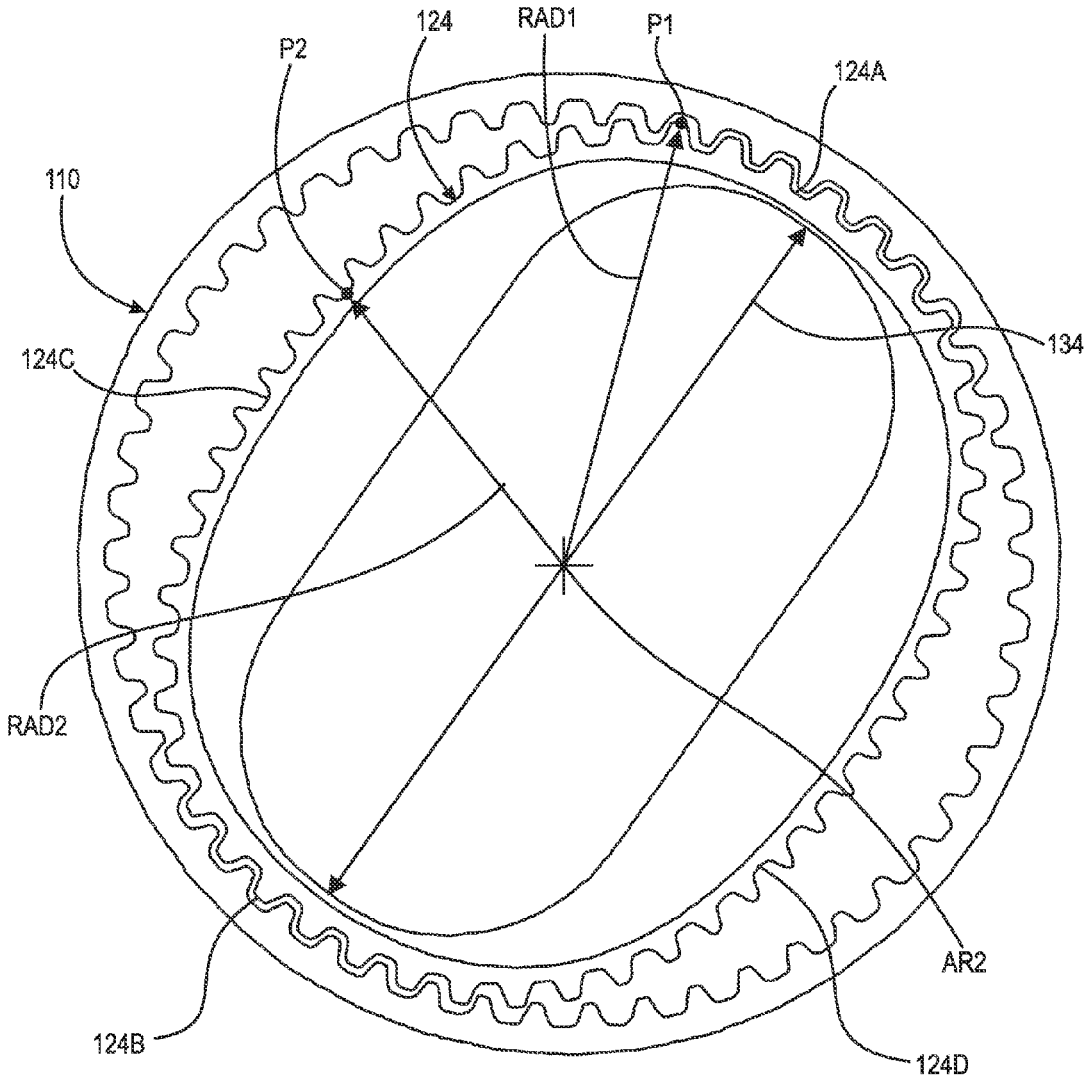
FIGS. 5A and 5B are schematic end views of a harmonic drive.
Figure 5B:
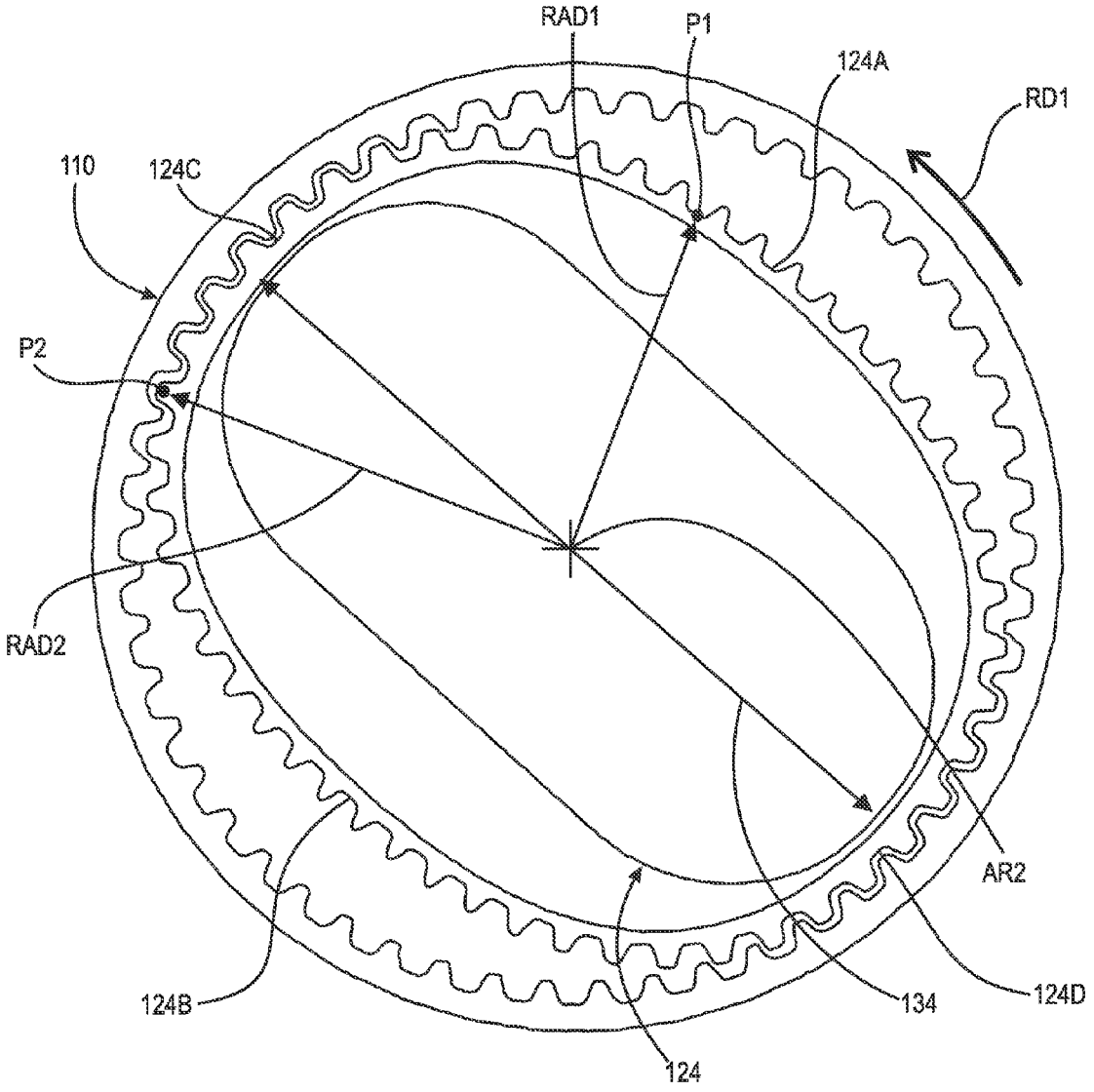

FIGS. 5A and 5B are schematic end views of a harmonic drive. The following should be viewed in light of FIGS. 2 through 5B. Assembly 100 includes electric motor 102, camshafts 104 and 106, input gear 108, output gear 110, and harmonic drive 112. At least a portion of camshaft 106 is disposed radially within camshaft 104. Gear 108 is non-rotatably connected to camshaft 104 and arranged to rotate, with respect to axis of rotation AR1 for camshafts 104 and 106, at a first speed in response to receiving rotational torque from crankshaft 114 of engine 116. Gear 110 is non-rotatably connected to camshaft 106. The harmonic drive includes wave generator 118 and flexible gear 120 radially disposed about the wave generator and having a plurality of drive teeth 122 forming radially outer circumference 124. Inner circumference 126 of the flexible gear is in contact with outer race 128 of the wave generator, which forms an outer circumference of the wave generator. The torque from the input gear rotates camshafts 104 and 106 to operate valve train 130 for the engine.

The electric motor is arranged to rotate the wave generator, with respect to the flexible gear, about axis of rotation AR2 for the wave generator, which is co-linear with output shaft 132 for the electric motor. The rotation of the wave generator with respect to the flexible gear changes respective radial distances of a plurality of points on the outer circumference of flexible gear 118 with respect to an axis of rotation for flexible gear 118, as further described below. The contact of the wave generator with the flexible gear urges only respective portions of drive teeth 122, and not all of drive teeth 122, into contact with gears 108 and 110 at any point in time. The engagement of drive teeth 122 with one of input gear 108 or output gear 110 is arranged to circumferentially off-sets camshaft 106 with respect to camshaft 104, that is, the rotation of the wave generator and the engagement of gear 120 with gear 108 or 110 controls phasing of camshaft 106 with respect to camshaft 104 and input gear 108. The following description of an example embodiment is directed to the case in which contact between flexible gear 120 and output gear 110 is used to off-set camshaft 106. However, it should be understood that the description is applicable to the case in which contact between flexible gear 120 and input gear 108 is used to off-set camshaft 106.

In FIG. 5, portions 124A and 124B of circumference 124 are maximally extended in a radial direction, orthogonal to axis AR2, by contact with the wave generator and are in contact with gears 108 and 110. Portions 124C and 124D are radially inwardly drawn by the "stretching" of the wave generator and are not in contact with gears 108 or 110. Portions of circumference 124 engaged with gears 108 or 110 are aligned with each other via straight line 134 passing through axis AR2. Thus, portions 124A and 124B are radially further from the axis for flexible gear 118, which is co-linear with axis AR2, than portions 124C and 124D. The rotation of wave generator 118 with respect to flexible gear 120 changes radial distances RAD1 and RAD2 of points P1 and P2 on the outer circumference of flexible gear 118 with respect to the axis of rotation for flexible gear 118. That is, the wave generator flexes and changes the shape of the outer circumference.

In FIG. 5A, RAD1 is clearly greater than RAD2. In FIG. 5B, the wave generator has rotated in direction RD1 and RAD1 is clearly less than RAD2. Therefore, the shapes of circumference 124 in FIGS. 5A and 5B are completely different from each other. It should be understood that FIGS. 5A and 5B are static illustrations and that the shape of circumference 124 continuously changes, for example, as the wave generator rotates in direction RD1. It should be understood that the shapes in FIG. 5 are for purposes of illustration only and that other shapes are possible for gears 108, 110, and 120 and the wave generator. Gear 110 is shown in FIGS. 5A and 5B; however, it should be understood that the discussion for FIGS. 5A and 5B is applicable when gear 108 is shown in place of gear 110.

Gear 108 includes plurality of teeth 136 and gear 110 includes plurality of teeth 138. In an example embodiment, there are a same number of teeth 136 as teeth 122 in a same circumferential span of respective portions of gears 108 and 120 including teeth 136 and 122, respectively. That is, each respective tooth 136 engages a same valley between adjacent teeth 122 during a full rotation of the wave generator. As a result, the flexible gear rotates at the same speed as the input gear. That is, each tooth 122 engages a same tooth 136 for each revolution of the wave generator. Note that the above discussion is applicable to the case in which there are a same number of teeth 138 as teeth 122 in a same circumferential span of respective portions of gears 110 and 120 including teeth 138 and 122, respectively, which results in the flexible gear rotating at the same speed as the output gear.

Figure 6A:
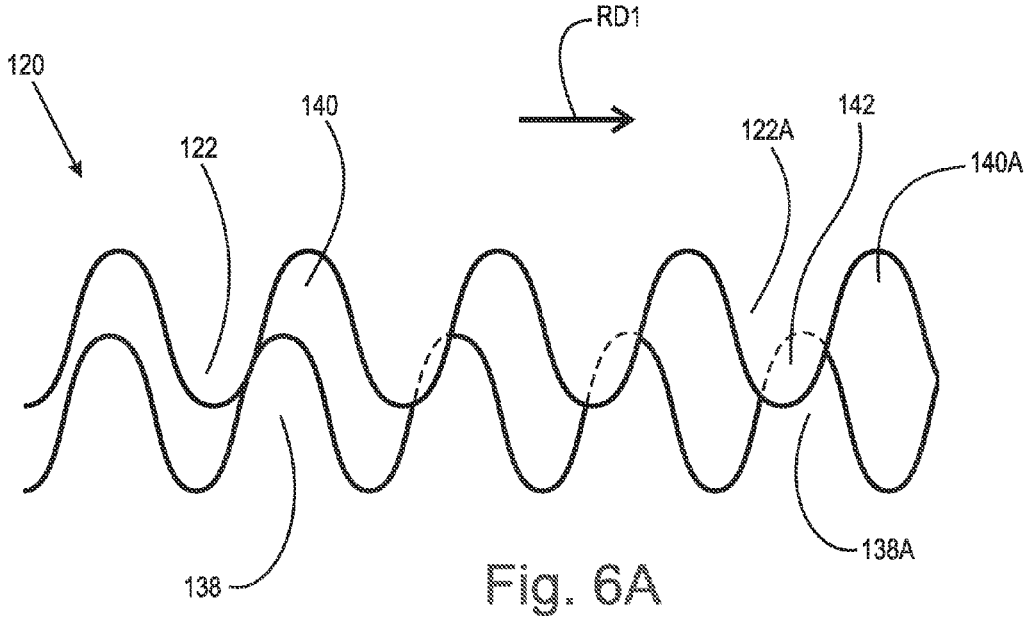
FIG. 6A is a schematic representation showing the output gear with more teeth than the flexible gear.

FIG. 6A is a schematic representation showing the output gear with more teeth than the flexible gear. The following should be viewed in light of FIGS. 2 through 6A. In an example embodiment as shown in FIG. 6A, there are more teeth 138 than teeth 122 in a same circumferential span of respective portions of gears 110 and 120 including teeth 138 and 122, respectively. As a result, there is not a one-to-one engagement of teeth 138 with valleys 140 of the flexible gear. If gear 110 is superimposed on gear 120, overlap areas 142 occur. For a direction of rotation of RD1 and example tooth 122A, there is an overlap with example tooth 138A. This overlap is biased toward forward valley 140A on the forward rotational side of tooth 122A. Since teeth 122 and 138 are circumferentially aligned, the overlap shown in FIG. 6A cannot occur. Instead, as tooth 138A begins to contact tooth 122A, tooth 138A is bumped into forward valley 140A to relieve the pressure between teeth 138A and 122A, which circumferentially offsets gear 110 and camshaft 106 in direction RD1 (advances camshaft 106) with respect to gear 108 and camshaft 104.

In like manner, overlaps between other pairs of teeth 138 and 122 cause respective teeth 138 to slide into respective forward valleys in an on-going process which maintains the circumferential off-set. The circumferential off-set noted above phases camshaft 106 with respect to input gear 108 and camshaft 104. The above discussion is applicable to the case in which there are more teeth 136 than teeth 122 in a same circumferential span of respective portions of gears 108 and 120 including teeth 136 and 122, respectively. This case also results in camshaft 106 being circumferentially off-set as described above.

Figure 6B:
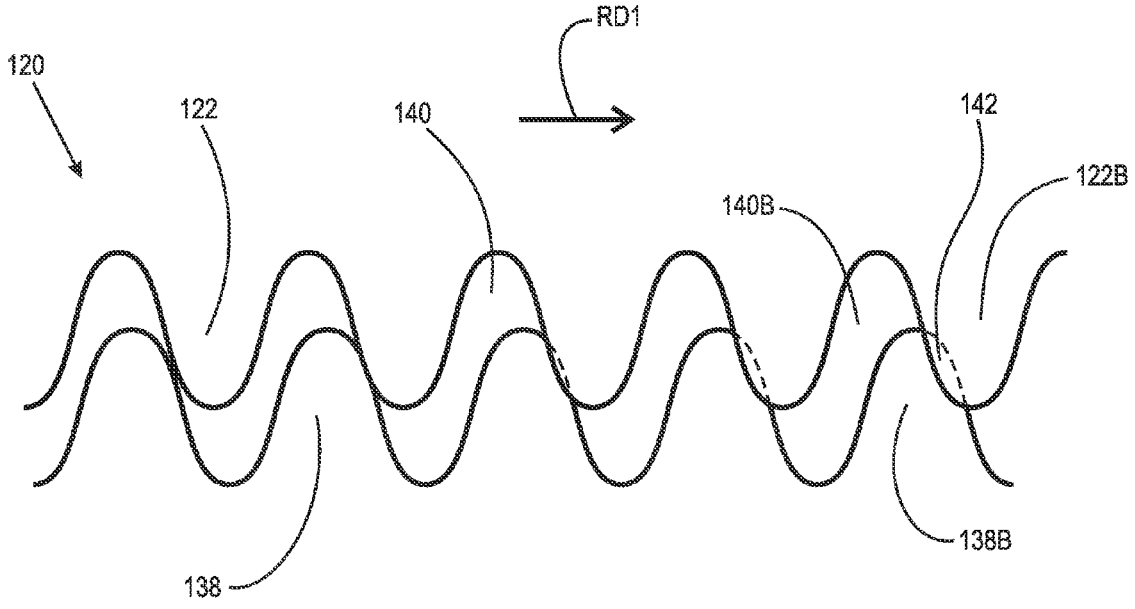
FIG. 6B is a schematic representation showing the output gear with fewer teeth than the flexible gear.

FIG. 6B is a schematic representation showing the output gear with fewer teeth than the flexible gear. The following should be viewed in light of FIGS. 2 through 6B. In an example embodiment as shown in FIG. 6B, there are fewer teeth 138 than teeth 122 in a same circumferential span of teeth 138 and 122. As a result, there is not a one-to-one engagement of teeth 138 with valleys 140 of the flexible gear. If gear 110 is superimposed on gear 120, overlap areas 142 occur. For a direction of rotation of RD1 and example tooth 122B, there is an overlap with example teeth 138B. This overlap is biased toward reverse valley 140B on the reverse rotational side of the tooth 122B. Since teeth 122 and 138 are circumferentially aligned, the overlap shown in FIG. 6B cannot occur. Instead, as tooth 138B begins to engage tooth 122B, tooth 138B is bumped into reverse valley 140B to relieve the pressure between teeth 138B and 122B, which circumferentially off-sets camshaft 106 in a direction opposite RD1 (retards camshaft 106) In like manner, overlaps between other pairs of teeth 138 and 122 cause respective teeth 138 to slide into respective reverse valleys to maintain the circumferential off-set. The circumferential off-set noted above phases camshaft 106 with respect to input gear 108 and camshaft 104. The above discussion is applicable to the case in which there are a fewer teeth 136 than teeth 122 in a same circumferential span of respective portions of gears 108 and 120 including teeth 136 and 122, respectively. This case also results in camshaft 106 being circumferentially off-set as described above.

For the example of FIG. 6A, increasing the speed of rotation of the wave generator increases the circumferential off-set of camshaft 106 with respect to camshaft 104 and further advances the phasing of camshaft 106. Decreasing the speed of rotation of the wave generator decreases the circumferential off-set of camshaft 106 with respect to camshaft 104 and retards the phasing of camshaft 106. For the example of FIG. 6B, increasing the speed of rotation of the wave generator decreases the circumferential off-set of camshaft 106 with respect to camshaft 104 and further retards the phasing of camshaft 106. Decreasing the speed of rotation of the wave generator increases the circumferential off-set of camshaft 106 with respect to camshaft 104 and advances the phasing of camshaft 106. The above discussion is applicable to the case in which there are a different number of teeth 136 than teeth 122 in a same circumferential span of respective portions of gears 108 and 120 including teeth 136 and 122, respectively.

Figure 7:
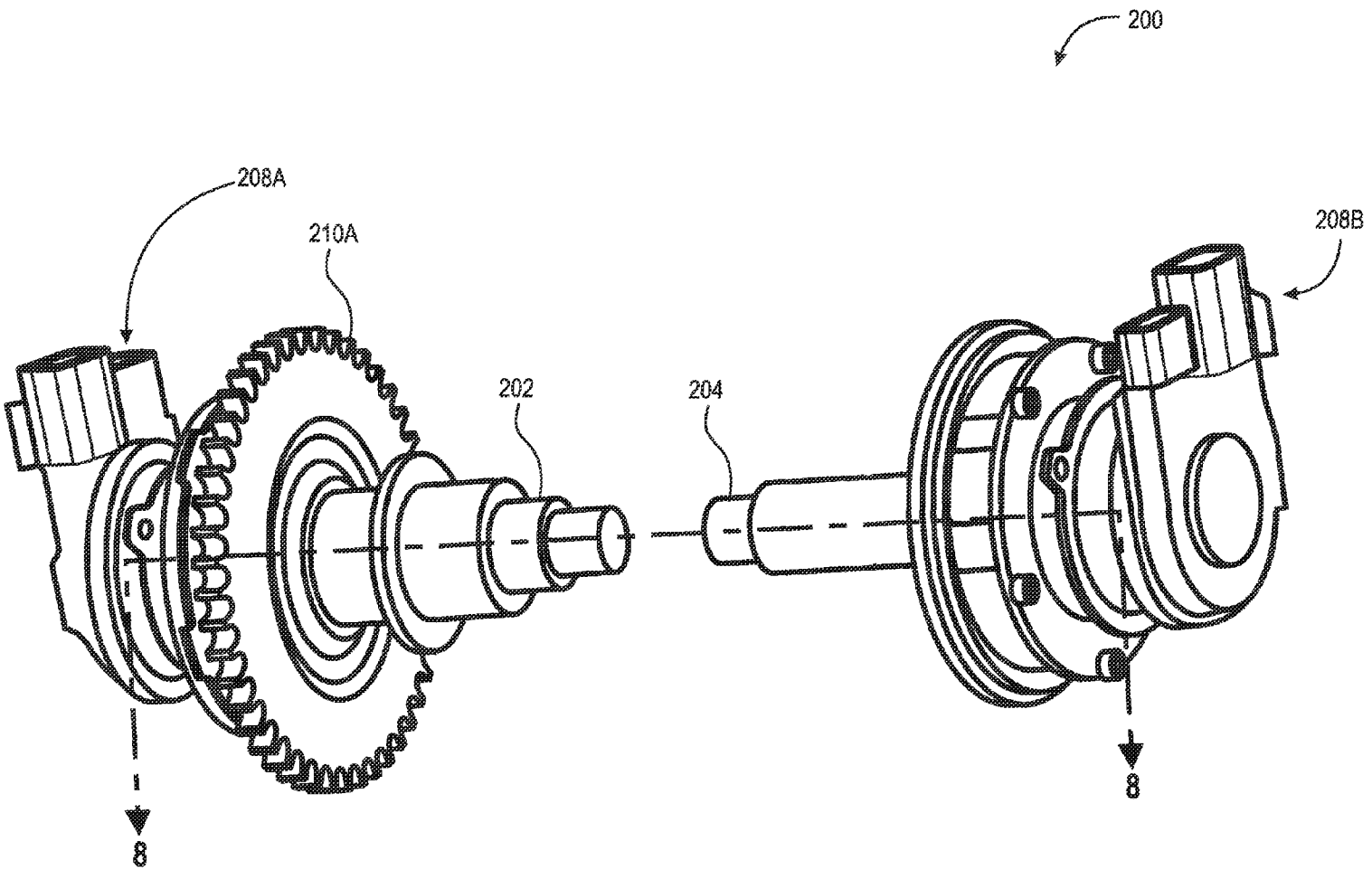
FIG. 7 is a perspective view of a concentric cam shaft assembly with electric phasing.

FIG. 7 is a perspective view of concentric cam shaft assembly 200 with electric phasing.

Figure 8:
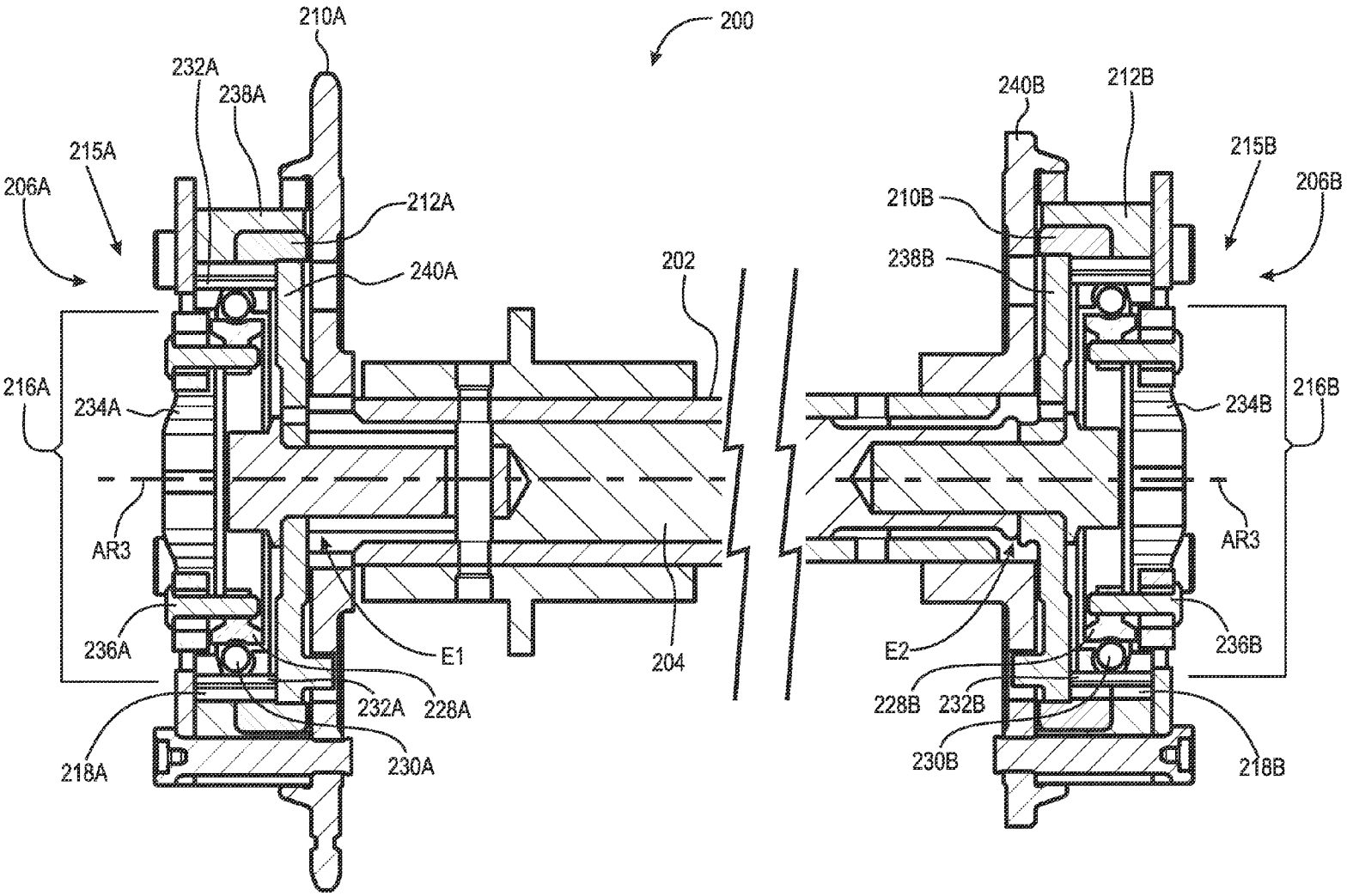
FIG. 8 is a cross-sectional view of the concentric cam shaft assembly of FIG. 7, with the electric motor removed, generally along line 8-8 in FIG. 7.

FIG. 8 is a cross-sectional view of concentric cam shaft assembly 200 of FIG. 7, with the electric motor removed, generally along line 8-8 in FIG. 7.

Figure 9:
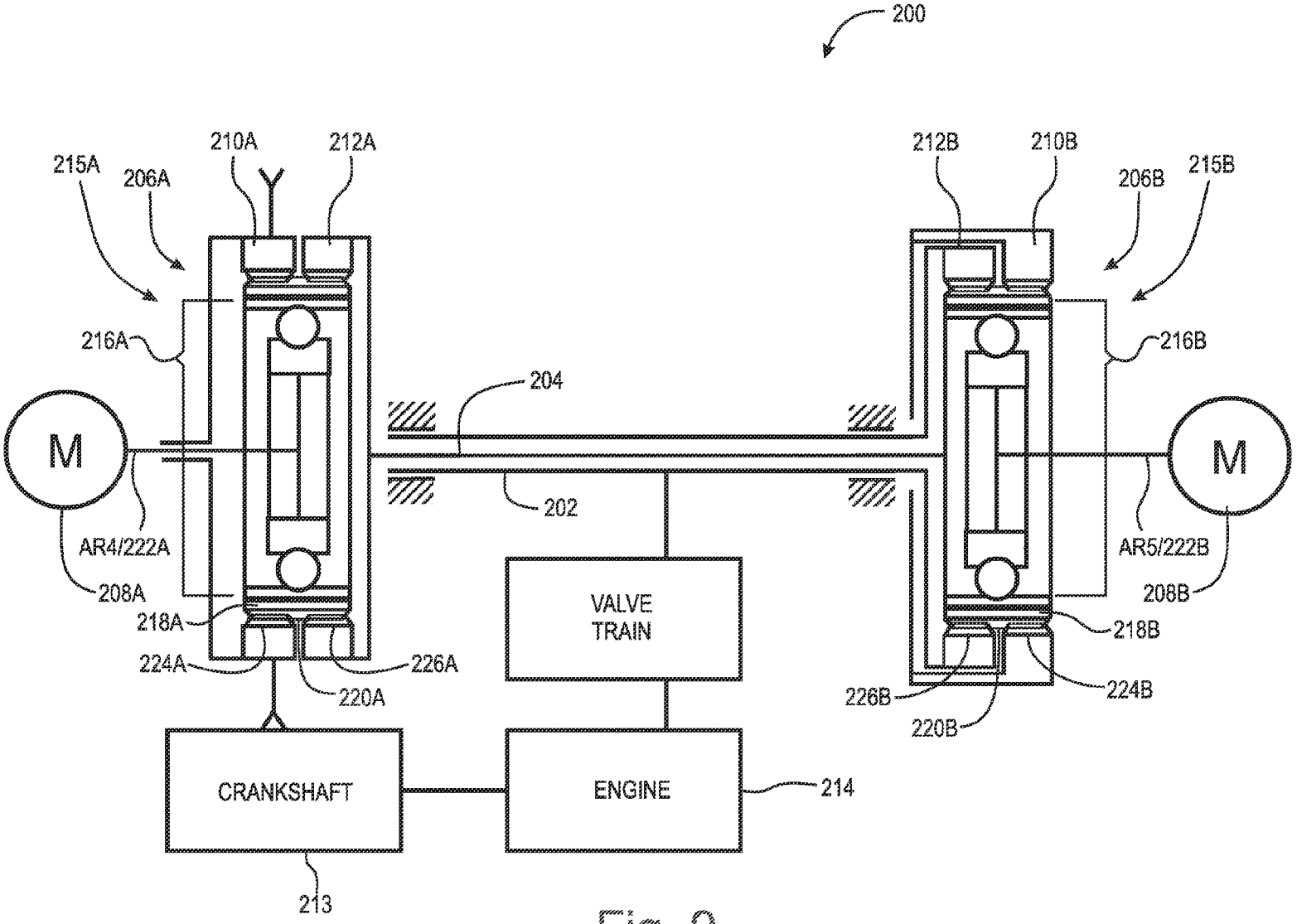
FIG. 9 is a schematic representation of the concentric cam shaft assembly of FIG. 7.

FIG. 9 is a schematic representation of concentric cam shaft assembly 200 of FIG. 7. The following should be viewed in light of FIGS. 2 through 9. Assembly 200 includes camshaft 202, camshaft 204 including at least a portion disposed radially within camshaft 202, phasing assembly 206A, and phasing assembly 206B. Phasing assembly 206A includes electric motor 208A, input gear 210A, and output gear 212A. Gear 210A is arranged to rotate at a first speed in response to receiving rotational torque from crankshaft 213 of engine 214. Gear 212A is non-rotatably connected to camshaft 204. Phasing assembly 206B includes electric motor 208B, input gear 210B, and output gear 212B. Gear 210B is non-rotatably connected to camshaft 202. Gear 212B is non-rotatably connected to camshaft 202. Motor 208A is arranged to circumferentially off-set camshaft 204 with respect to input gear 210A and phase camshaft 204 with respect to rotation of the crankshaft. Motor 208B is arranged to circumferentially off-set camshaft 202 with respect to camshaft 204 and phase camshaft 202 with respect to rotation of the crankshaft. As shown in FIG. 8, output gear 212A is connected to axial end E1 of camshaft 204 and input gear 210B is connected to axial end E2, opposite the end E1, of camshaft 204. "Axial" is defined with respect to an axis of rotation AR3 for camshafts 202 and 204.

In an example embodiment, phasing assembly 206A includes harmonic drive 215A with wave generator 216A, and flexible gear 218A radially disposed about wave generator 216A. Gear 218A includes a plurality of drive teeth 220A. The discussion regarding the structure and operation of electric motor 102, harmonic drive 112, wave generator 118, flexible gear 120, and drive teeth 122 is applicable to electric motor 208A, harmonic drive 215A, wave generator 216A, flexible gear 218A, and drive teeth 220A. In an example embodiment, phasing assembly 206B includes a harmonic drive 215B wave generator 216B, and flexible gear 218B radially disposed about wave generator 216B. Gear 218B includes a plurality of drive teeth 220B. The discussion regarding the structure and operation of electric motor 102, harmonic drive 112, wave generator 118, flexible gear 120, and drive teeth 122 is applicable to electric motor 208B, harmonic drive 215B, wave generator 216B, flexible gear 218B, and drive teeth 220B. The discussion for FIG. 5 is applicable to harmonic drives 214A and 214B.

Electric motor 208A is arranged to rotate wave generator 216A, with respect to flexible gear 218A, about axis of rotation AR4 for wave generator 216A, which is co-linear with output shaft 222A for electric motor 208A. The discussion for FIG. 5 is applicable to harmonic drive 215A, that is, the rotation of wave generator 216A with respect to flexible gear 218A continually changes a shape of the outer circumference of flexible gear 218A in a radial direction, as described for wave generator 118 and flexible gear 120. The contact of wave generator 216A with flexible gear 218A urges only respective portions of drive teeth 220A, and not all of drive teeth 220A, into contact with gears 210A and 212A at any point in time. The engagement of drive teeth 220A with output gear 212A is arranged to circumferentially off-set output gear 212A with respect to input gear 210A, which circumferentially off-sets camshaft 204 with respect to camshaft 202.

Electric motor 208B is arranged to rotate wave generator 216B, with respect to flexible gear 218B, about axis of rotation AR5 for wave generator 216B, which is co-linear with output shaft 222B for electric motor 208B. The discussion for FIG. 5 is applicable to harmonic drive 215B, that is, the rotation of wave generator 216B with respect to flexible gear 218B continually changes a shape of the outer circumference of flexible gear 218B in a radial direction, as described for wave generator 118 and flexible gear 120. The contact of wave generator 216B with flexible gear 218B urges only respective portions of drive teeth 220B, and not all of drive teeth 220B, into contact with gears 210B and 212B at any point in time. The engagement of drive teeth 220B with output gear 212B is arranged to circumferentially off-set output gear 212B with respect to input gear 210B, which circumferentially off-sets camshaft 202 with respect to camshaft 204.

Input gears 210A/B include respective pluralities of teeth 224A/B and output gears 212A/B include respective pluralities of teeth 226A/B. In an example embodiment, the number of teeth 222A per a circumferential extent of gear 218A is equal to the number of teeth 224A per a same circumferential extent of gear 210A. That is, each respective tooth 224A engages a same valley between adjacent teeth 222A during a full rotation of wave generator 216A. As a result, flexible gear 218A rotates at the same speed as input gear 210A. In an example embodiment, the number of teeth 222B per a circumferential extent of gear 218B is equal to the number of teeth 224B per a same circumferential extent of gear 210B. That is, each respective tooth 224B engages a same valley between adjacent teeth 222B during a full rotation of wave generator 216B. As a result, flexible gear 218B rotates at the same speed as input gear 210B. The above discussion is applicable to the case in which there are a same number of teeth for output gear 212A as teeth 222A in a same circumferential span of respective portions of output gear 212A and gears 218A; and to the case in which there are a same number of teeth for output gear 212B as teeth 222B in a same circumferential span of respective portions of output gear 212B and gears 218B.

The discussion of FIGS. 6A and 6B is applicable to harmonic drive 215A. For example, in case in which there are more teeth 226A than teeth 220A in a same circumferential span of gears 218A and 212A, camshaft 204 is advanced with respect to camshaft 202. Increasing the speed of rotation of wave generator 216A advances the phasing of camshaft 204. Decreasing the speed of rotation of wave generator 216A retards the phasing of camshaft 204.

For example, in case in which there are fewer teeth 226A than teeth 220A in a same circumferential span of gears 218A and 212A, camshaft 204 is retarded with respect to camshaft 202. Increasing the speed of rotation of wave generator 216A further retards the phasing of camshaft 204. Decreasing the speed of rotation of wave generator 216A advances the phasing of camshaft 204. The above discussion regarding FIGS. 6A and 6B is applicable to the case in which there are a different number of teeth for input gear 210A than teeth 222A in a same circumferential span of respective portions of input gear 210A and gears 218A; and to the case in which there are a different number of teeth for input gear 210B than teeth 222B in a same circumferential span of respective portions of input gear 210B and gears 218B.

The discussion of FIGS. 6A and 6B is applicable to harmonic drive 215B. For example, in case in which there are more teeth 226B than teeth 220B in a same circumferential span of gears 218B and 212B, camshaft 202 is advanced with respect to camshaft 204. Increasing the speed of rotation of wave generator 216B advances the phasing of camshaft 202. Decreasing the speed of rotation of wave generator 216B retards the phasing of camshaft 202.

For example, in case in which there are fewer teeth 226B than teeth 220B in a same circumferential span of gears 218B and 212B, camshaft 202 is retarded with respect to camshaft 204. Increasing the speed of rotation of wave generator 216B further retards the phasing of camshaft 202. Decreasing the speed of rotation of wave generator 216B advances the phasing of camshaft 202. The preceding discussion is applicable to the cases in there are more or fewer teeth 224A/B than teeth 220A/B in a same circumferential span of gears 210A/B and 218A/B.

Figure 10:
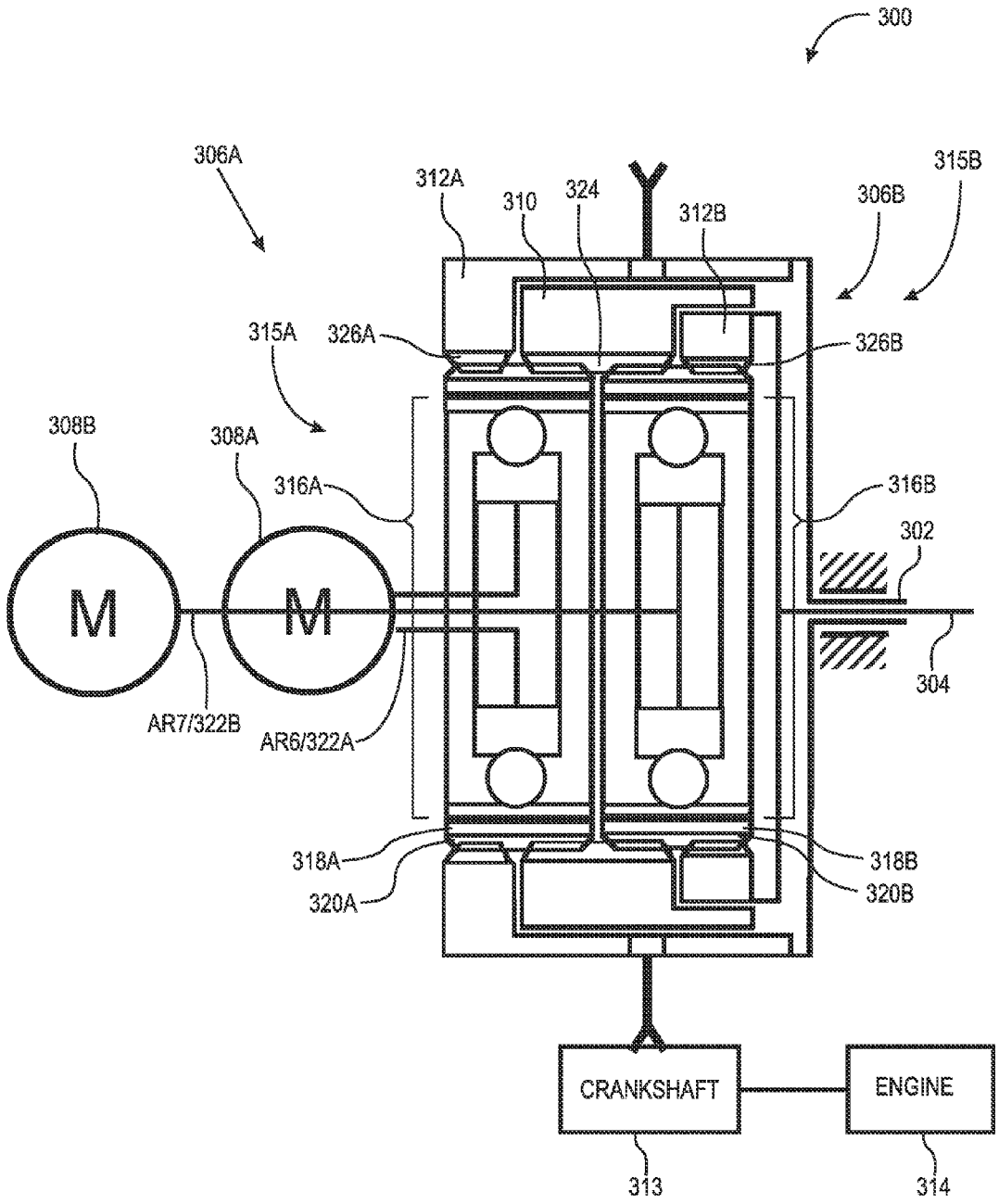
FIG. 10 is a schematic representation of a concentric cam shaft assembly with electric phasing and nested phasing assemblies; and, FIG. 11 is a schematic representation of a concentric cam shaft assembly with electric phasing and nested phasing assemblies.

FIG. 10 is a schematic representation of concentric cam shaft assembly 300 with electric phasing and nested phasing assemblies. The following should be viewed in light of FIGS. 2 through 6B and 10. Assembly 300 includes camshaft 302, camshaft 304 including at least a portion disposed radially within camshaft 302, and phasing assemblies 306A and 306B. Phasing assembly 306A includes electric motor 308A, input gear 310, and output gear 312A. Gear 310 is arranged to rotate at a first speed in response to receiving rotational torque from crankshaft 313 of engine 314. Gear 312A is non-rotatably connected to camshaft 302. Phasing assembly 306B includes electric motor 308B, input gear 310, and output gear 312B. Gear 312B is non-rotatably connected to camshaft 304.

Motor 308A is arranged to rotate camshaft 302 with respect to input gear 310 and phase camshaft 302 with respect to input gear 310 and rotation of the crankshaft. Motor 308B is arranged to rotate camshaft 304 with respect to input gear 310 and phase camshaft 304 with respect to input gear 310 and rotation of the crankshaft. Thus, camshafts 302 and 304 are separately and individually phaseable with respect to input gear 310.

In an example embodiment, phasing assembly 306A includes harmonic drive 315A with wave generator 316A, and flexible gear 318A radially disposed about wave generator 316A. Gear 318A includes a plurality of drive teeth 320A. The discussion regarding the structure and operation of electric motor 102, harmonic drive 112, wave generator 118, flexible gear 120, and drive teeth 122 is applicable to electric motor 308A, harmonic drive 315A, wave generator 316A, flexible gear 318A, and drive teeth 320A. In an example embodiment, phasing assembly 306B includes a harmonic drive 315B, wave generator 316B, and flexible gear 318B radially disposed about wave generator 316B. Gear 318B includes a plurality of drive teeth 320B. The discussion regarding the structure and operation of electric motor 102, harmonic drive 112, wave generator 118, flexible gear 120, and drive teeth 122 is applicable to electric motor 308B, harmonic drive 315B, wave generator 316B, flexible gear 318B, and drive teeth 320B. The discussion for FIG. 5 is applicable to harmonic drives 314A and 314B.

Electric motor 308A is arranged to rotate wave generator 316A, with respect to flexible gear 318A, about axis of rotation AR6 for wave generator 316A, which is co-linear with output shaft 322A for electric motor 308A. The rotation of wave generator 316A with respect to flexible gear 318A continually changes a shape of the outer circumference of flexible gear 318A in a radial direction, as described for wave generator 118 and flexible gear 120. The contact of wave generator 316A with flexible gear 318A urges only respective portions of drive teeth 320A, and not all of drive teeth 320A, into contact with gears 310A and 312A at any point in time. The engagement of drive teeth 320A with output gear 312A is arranged to circumferentially off-set output gear 312A with respect to input gear 310, which circumferentially off-sets camshaft 302 with respect to gear 310.

Electric motor 308B is arranged to rotate wave generator 316B, with respect to flexible gear 318B, about axis of rotation AR7 for wave generator 316B, which is co-linear with output shaft 322B for electric motor 308B. The rotation of wave generator 316B with respect to flexible gear 318B continually changes a shape of the outer circumference of flexible gear 318B in a radial direction, as described for wave generator 118 and flexible gear 120. The contact of wave generator 316B with flexible gear 318B urges only respective portions of drive teeth 320B, and not all of drive teeth 320B, into contact with gears 310B and 312B at any point in time. The engagement of drive teeth 320B with output gear 312B is arranged to circumferentially off-set output gear 312B with respect to input gear 310, which circumferentially off-sets camshaft 304 with respect to input gear 310. In an example embodiment, shaft 322B is nested within shaft 322A.

Input gear 310 include a plurality of teeth 324 and output gears 312A/B include respective pluralities of teeth 326A/B. In an example embodiment, the number of teeth 322A per a circumferential extent of gear 318A is equal to the number of teeth 324 per a same circumferential extent of gear 310. That is, each respective tooth 324 engages a same valley between adjacent teeth 322A during a full rotation of wave generator 316A. As a result, flexible gear 318A rotates at the same speed as input gear 310. In an example embodiment, the number of teeth 322B per a circumferential extent of gear 318B is equal to the number of teeth 324 per a same circumferential extent of gear 310. That is, each respective tooth 324 engages a same valley between adjacent teeth 322B during a full rotation of wave generator 316B. As a result, flexible gear 318B rotates at the same speed as input gear 310. The above discussion is applicable to the case in which there are a same number of teeth for output gear 312A as teeth 322A in a same circumferential span of respective portions of output gear 312A and gears 318A; and to the case in which there are a same number of teeth for output gear 312B as teeth 322B in a same circumferential span of respective portions of output gear 312B and gears 318B.

The discussion of FIGS. 6A and 6B is applicable to harmonic drive 315A. For example, in case in which there are more teeth 326A than teeth 220A in a same circumferential span of gears 318A and 312A, camshaft 302 is advanced with respect to gear 310. Increasing the speed of rotation of wave generator 316A advances the phasing of camshaft 302. Decreasing the speed of rotation of wave generator 316A retards the phasing of camshaft 302.

For example, in case in which there are fewer teeth 326A than teeth 320A in a same circumferential span of gears 318A and 312A, camshaft 302 is retarded with respect to gear 310. Increasing the speed of rotation of wave generator 316A further retards the phasing of camshaft 302. Decreasing the speed of rotation of wave generator 316A advances the phasing of camshaft 302.

The discussion of FIGS. 6A and 6B is applicable to harmonic drive 315B. For example, in case in which there are more teeth 326B than teeth 320B in a same circumferential span of gears 318B and 312B, camshaft 304 is advanced with respect to gear 310. Increasing the speed of rotation of wave generator 316B advances the phasing of camshaft 304. Decreasing the speed of rotation of wave generator 316B retards the phasing of camshaft 304.

For example, in case in which there are fewer teeth 326B than teeth 320B in a same circumferential span of gears 318B and 312B, camshaft 304 is retarded with respect to gear 310. Increasing the speed of rotation of wave generator 316B further retards the phasing of camshaft 304. Decreasing the speed of rotation of wave generator 316B advances the phasing of camshaft 304. The above discussion regarding FIGS. 6A and 6B is applicable to the case in which there are a different number of teeth for input gear 310 than teeth 322A or 322B in a same circumferential span of respective portions of input gear 310 and gears 318A or 318B.

Figure 11:
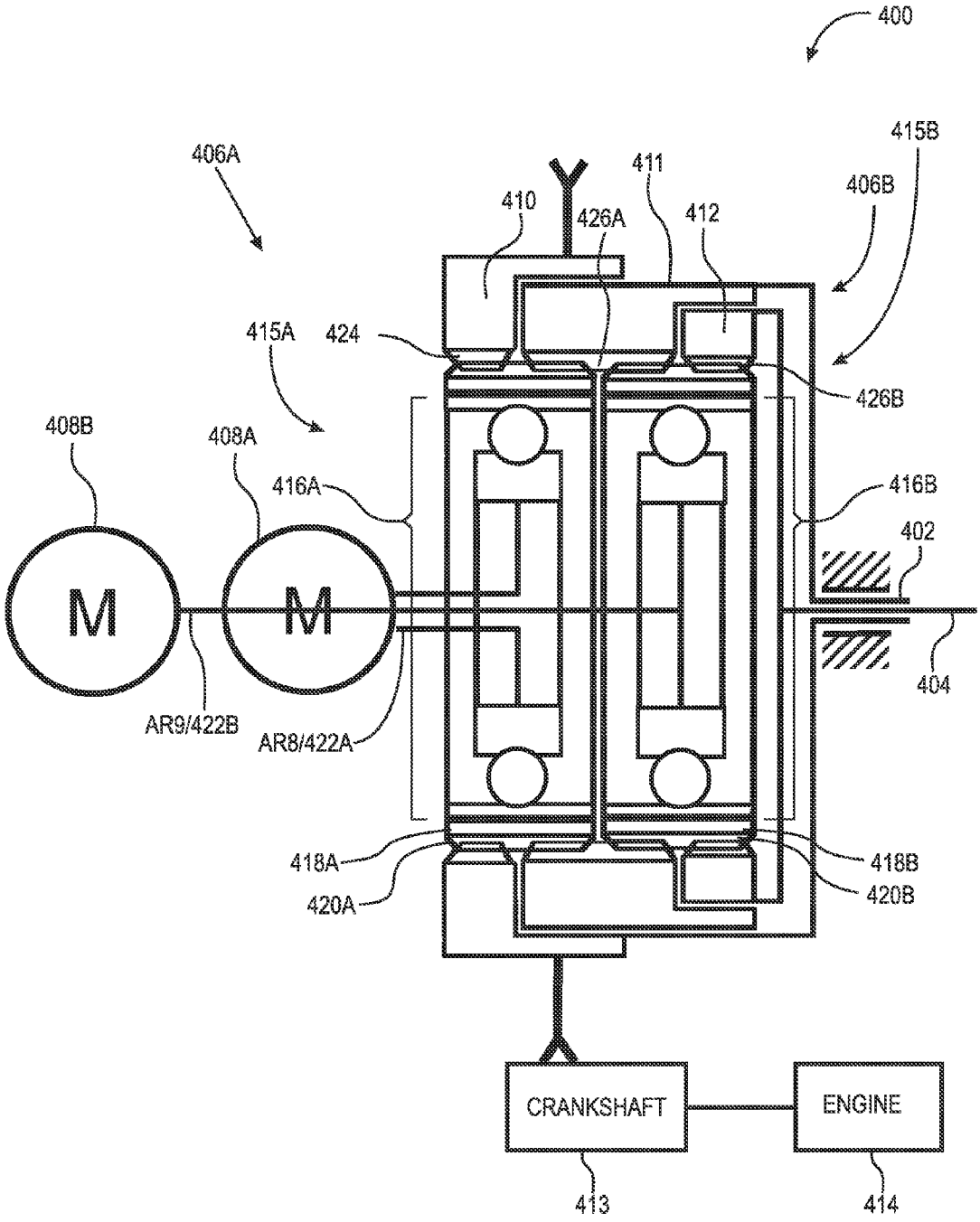

FIG. 11 is a schematic representation of concentric cam shaft assembly 400 with electric phasing and nested phasing assemblies. The following should be viewed in light of FIGS. 2 through 6B, and 11. Assembly 400 includes camshaft 402, camshaft 404 including at least a portion disposed radially within camshaft 402, and phasing assemblies 406A and 406B. Phasing assembly 406A includes electric motor 408A, input gear 410, and output/input gear 411. Gear 410 is arranged to rotate at a first speed in response to receiving rotational torque from crankshaft 413 of engine 414. Gear 411 is non-rotatably connected to camshaft 402. Phasing assembly 406B includes electric motor 408B, output/input gear 411, and output gear 412. Gear 412 is non-rotatably connected to camshaft 404.

Motor 408A is arranged to circumferentially off-set camshaft 402 with respect to input gear 410 and phase camshaft 402 with respect to rotation of input gear 410 and the crankshaft. Motor 408B is arranged to circumferentially off-set camshaft 404 with respect to output/input gear 411 and phase camshaft 404 with respect to output/input gear 411 and camshaft 402.

In an example embodiment, phasing assembly 406A includes harmonic drive 415A with wave generator 416A, and flexible gear 418A radially disposed about wave generator 416A. Gear 418A includes a plurality of drive teeth 420A. The discussion regarding the structure and operation of electric motor 102, harmonic drive 112, wave generator 118, flexible gear 120, and drive teeth 122 is applicable to electric motor 408A, harmonic drive 415A, wave generator 416A, flexible gear 418A, and drive teeth 420A. In an example embodiment, phasing assembly 406B includes a harmonic drive 415B wave generator 416B, and flexible gear 418B radially disposed about wave generator 416B. Gear 418B includes a plurality of drive teeth 420B. The discussion regarding the structure and operation of electric motor 102, harmonic drive 112, wave generator 118, flexible gear 120, and drive teeth 122 is applicable to electric motor 408B, harmonic drive 415B, wave generator 416B, flexible gear 418B, and drive teeth 420B. The discussion for FIG. 5 is applicable to harmonic drives 414A and 414B.

Electric motor 408A is arranged to rotate wave generator 416A, with respect to flexible gear 418A, about axis of rotation AR8 for wave generator 416A, which is co-linear with output shaft 422A for electric motor 408A. The rotation of wave generator 416A with respect to flexible gear 418A continually changes a shape of the outer circumference of flexible gear 418A in a radial direction, as described for wave generator 118 and flexible gear 120. The contact of wave generator 416A with flexible gear 418A urges only respective portions of drive teeth 420A, and not all of drive teeth 420A, into contact with gears 410 and 411 at any point in time. The engagement of drive teeth 420A with output gear 410 is arranged to circumferentially off-set output gear 410 with respect to input/output gear 411, which circumferentially off-sets camshaft 402 with respect to gear 411.

Electric motor 408B is arranged to rotate wave generator 416B, with respect to flexible gear 418B, about axis of rotation AR9 for wave generator 416B, which is co-linear with output shaft 422B for electric motor 408B. The rotation of wave generator 416B with respect to flexible gear 418B continually changes a shape of the outer circumference of flexible gear 418B in a radial direction, as described for wave generator 118 and flexible gear 120. The contact of wave generator 416B with flexible gear 418B urges only respective portions of drive teeth 420B, and not all of drive teeth 420B, into contact with gears 411 and 412 at any point in time. The engagement of drive teeth 420B with output gear 412 is arranged to circumferentially off-set output gear 412 with respect to input/output gear 411, which circumferentially off-sets camshaft 404 with respect to gear 411.

Input gear 410 includes a plurality of teeth 424, output/input gear 411 includes a plurality of teeth 426A, and output gear 412 includes a plurality of teeth 426B. In an example embodiment, the number of teeth 424 is equal to the number of teeth 420A, in a same circumferential span of gears 418A and 410. As a result, flexible gear 418A rotates at the same speed as input gear 410. In an example embodiment, the number of teeth 426B is equal to the number of teeth 420B, in a same circumferential span of gears 418A and 411. As a result, flexible gear 418B rotates at the same speed as output/input gear 411. The above discussion is applicable to the case in which there are a same number of teeth for gear 411 as teeth 422A in a same circumferential span of respective portions of gear 411 and gear 418A; and to the case in which there are a same number of teeth for gear 411 as teeth 422B in a same circumferential span of respective portions of gear 411 and gear 418B.

The discussion of FIGS. 6A and 6B is applicable to harmonic drive 415A. For example, in case in which there are more teeth 426A than teeth 420A in a same circumferential span of gears 418A and 411, camshaft 402 is advanced with respect to gear 410. Increasing the speed of rotation of wave generator 416A advances the phasing of camshaft 402. Decreasing the speed of rotation of wave generator 416A retards the phasing of camshaft 402.

For example, in case in which there are fewer teeth 426A than teeth 420A in a same circumferential span of gears 418A and 411, camshaft 402 is retarded with respect to gear 410. Increasing the speed of rotation of wave generator 416A further retards the phasing of camshaft 402. Decreasing the speed of rotation of wave generator 416A advances the phasing of camshaft 402.

The discussion of FIGS. 6A and 6B is applicable to harmonic drive 415B. For example, in case in which there are more teeth 426B than teeth 420B in a same circumferential span of gears 418B and 412, camshaft 404 is advanced with respect to gear 411. Increasing the speed of rotation of wave generator 416B advances the phasing of camshaft 404. Decreasing the speed of rotation of wave generator 416B retards the phasing of camshaft 404.

For example, in case in which there are fewer teeth 426B than teeth 420B in a same circumferential span of gears 418B and 412, camshaft 404 is retarded with respect to gear 411. Increasing the speed of rotation of wave generator 416B further retards the phasing of camshaft 404. Decreasing the speed of rotation of wave generator 416B advances the phasing of camshaft 404. The above discussion regarding FIGS. 6A and 6B is applicable to the case in which there are a different number of teeth for input gear 411 than teeth 422A or 422B in a same circumferential span of respective portions of input gear 411 and gears 418A or 418B.

In an example embodiment the components described below are included in assembly 100. Wave generator 118 includes rotor 118A and a plurality of balls 118B disposed between the rotor and outer race 126. The balls facilitate rotation of the rotor with respect to the outer race. In an example embodiment, shaft 132 is connected to interface 146, which is connected to the rotor by fasteners 148. Bridge piece 150 is non-rotatably connected to gear 108 and teeth 136 are on bridge piece 150. Gear 108 and bridge piece 150 can be made of a single piece of material. Bridge piece 152 is non-rotatably connected to gear 110 and camshaft 106. Gear 110 and bridge piece 152 can be made of a single piece of material.

In an example embodiment the components described below are included in assembly 200. Wave generator 216A includes rotor 228A and a plurality of balls 230A disposed between rotor 228A and outer race 232A. The balls facilitate rotation of rotor 228A with respect to outer race 232A. In an example embodiment, shaft 222A is connected to interface 234A, which is connected to rotor 228A by fasteners 236A. Bridge piece 238A is non-rotatably connected to gear 210A and teeth 224A are on bridge piece 238. Gear 210A and bridge piece 238A can be made of a single piece of material. Bridge piece 240A is non-rotatably connected to gear 212A and camshaft 204. Gear 212A and bridge piece 240A can be made of a single piece of material. Wave generator 216B includes rotor 228B and a plurality of balls 230B disposed between rotor 228B and outer race 232B. The balls facilitate rotation of rotor 228A with respect to outer race 232B. In an example embodiment, shaft 222B is connected to interface 234B, which is connected to rotor 228B by fasteners 236B. Bridge piece 238B is non-rotatably connected to gear 210B and teeth 224B are on bridge piece 238B. Gear 210B and bridge piece 238B can be made of a single piece of material. Bridge piece 240B is non-rotatably connected to gear 212B and camshaft 202. Gear 212B and bridge piece 240B can be made of a single piece of material.

The following provides further detail regarding assemblies 100, 200, and 300. Advantageously, assemblies 100, 200, and 300 enable more flexibility for engine design by enabling greater control of and variation of camshaft phasing (and valve opening and closing events). Specifically, the phasing can be dynamically tailored to specific operating conditions such as engine speed and load. In comparison to hydraulic phasing system, assemblies 100, 200, and 300 have reduced space requirements, provide increased shift velocity over a wider range of operating conditions, are not subject to degraded operation by conditions such a cold oil temperatures, have faster response times, have unlimited shift authority, and are independent of oil pressure from an engine oil pump. Since the oil pump is not needed to control phasing, the oil pump can be sized smaller to increase efficiency and reduce losses.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A concentric cam shaft assembly, comprising:

an electric motor;

a first camshaft;

a second camshaft including at least a portion disposed radially within the first camshaft;

an input gear:

non-rotatably connected to the first camshaft such that relative rotation between the input gear and the first camshaft is not possible; and, arranged to rotate at a first speed, with respect to an axis of rotation for the first and second camshafts, in response to receiving rotational torque from a crankshaft of an engine;

an output gear non-rotatably connected to the second camshaft; and, a harmonic drive including:

a wave generator; and, a flexible gear radially disposed about the wave generator and including a radially inner circumference in contact with the wave generator, and a radially outer circumference with a plurality of drive teeth, wherein:

the input gear is arranged to rotate the first and second camshafts at the first speed;

the electric motor is arranged to rotate the wave generator, with respect to the flexible gear, about an axis of rotation for the wave generator:

to change respective radial distances of a plurality of points on the outer circumference of the flexible gear with respect to an axis of rotation for the flexible gear;

to urge only a respective portion of the plurality of drive teeth, and not all of the drive teeth, into contact with the one of the input or output gears; and, to circumferentially off-set, using an engagement of the respective portion of the plurality of drive teeth with the one of the input or output gears, the second camshaft with respect to the first camshaft.

2. The concentric cam shaft assembly of claim 1, wherein:

the respective portions of the plurality of drive teeth include:

a first portion; and, a second portion aligned with the first portion via a first straight line passing through the first axis of rotation.

3. The concentric cam shaft assembly of claim 2, wherein:

the plurality of drive teeth include third and fourth portions not in contact with the input or output gears when the first and second portions are in contact with the input and output gears; and, the third and fourth portions are radially closer to the axis of rotation for the wave generator than the first and second portions.

4. The concentric cam shaft assembly of claim 1, wherein:

the flexible gear is arranged to rotate at the first speed.

5. The concentric cam shaft assembly of claim 1, wherein:

the one of the input or output gears includes a first plurality of teeth having a first number of teeth in a first circumferential span of a portion of the one of the input or output gears including the first plurality of teeth;

the flexible gear includes a second plurality of teeth having a second number of teeth in a second circumferential span, equal to the first circumferential span, of a portion of the flexible gear including the second plurality of teeth; and, the first number is less than or greater than the second number.

6. The concentric cam shaft assembly of claim 5, wherein:

the first number is greater than the second number;

increasing a speed of rotation for the wave generator increases a circumferential off-set between the first and second camshafts; and, decreasing the speed of rotation for the wave generator decreases the circumferential off-set.

7. The concentric cam shaft assembly of claim 5, wherein:

the first number is less than the second number;

increasing a speed of rotation for the wave generator decreases a circumferential off-set between the first and second camshafts; and, decreasing the speed of rotation for the wave generator increases the circumferential off-set.

8. A method of operating a concentric cam shaft assembly including an electric motor, a first camshaft, a second camshaft including at least a portion disposed radially within the first camshaft, an input gear, an output gear non-rotatably connected to the second camshaft, and a harmonic drive including a wave generator and a flexible gear radially disposed about the wave generator and including a radially inner circumference in contact with the wave generator, and a radially outer circumference with a plurality of drive teeth, the method comprising:

non-rotatably connecting the input gear to the first camshaft such that relative rotation between the input gear and the first camshaft is not possible;

receiving, with the input gear, rotational torque from a crankshaft of an engine;

rotating, with the input gear, the first and second camshafts;

rotating, with the electric motor, the wave generator, with respect to the flexible gear, about an axis of rotation for the wave generator;

changing, with the wave generator, respective radial distances of a plurality of points on the outer circumference of the flexible gear with respect to an axis of rotation for the flexible gear;

urging, with the wave generator, only respective portions of the plurality of drive teeth, and not all of the drive teeth, into contact with one of the input or output gears;

engaging the plurality of drive teeth with the one of the input or output gears; and, circumferentially off-setting, using an engagement of the respective portion of the plurality of drive teeth with the one of the input or output gears, the second camshaft with respect to the first camshaft.

9. The method of claim 8, wherein:

engaging the plurality of drive teeth with the input and output gears includes aligning first and second portions from the respective portions of the drive teeth with a first straight line passing through the first axis of rotation.

10. The method of claim 9, wherein:

engaging the plurality of drive teeth with the input and output gears includes:

keeping third and fourth portions of the respective portions of the drive teeth out of contact with the input and output gears when the first and second portions are in contact with the input and output gears; and, displacing the third and fourth portions radially closer to the axis of rotation for the wave generator than the first and second portions.

11. The method of claim 9, wherein:

the one of the input or output gears includes a first plurality of teeth having a first number of teeth in a first circumferential span of a portion of the one of the input or output gears including the first plurality of teeth;

the flexible gear includes a second plurality of teeth having a second number of teeth in a second circumferential span, equal to the first circumferential span, of a portion of the flexible gear including the second plurality of teeth; and, the first number is less than or greater than the second number.

12. The method of claim 11, wherein:

the first number is greater than the second number, the method further comprising:

increasing a speed of rotation for the wave generator to increase a circumferential off-set between the first and second camshafts; and, decreasing the speed of rotation for the wave generator to decrease the circumferential off-set.

13. The method of claim 11, wherein:

the first number is less than the second number, the method further comprising:

increasing a speed of rotation for the wave generator to decrease a circumferential off-set between the first and second camshafts; and, decreasing the speed of rotation for the wave generator to increase the circumferential off-set.

14. The method of claim 8, further comprising:

rotating the flexible gear at the first speed.

* * * * *